United States Patent [19]

Lin

[11] Patent Number: 4,726,128

[45] Date of Patent: Feb. 23, 1988

[54] ZIPPERED ATHLETIC SHOE POCKET

[76] Inventor: Danny Lin, 132 Duane St., New York, N.Y. 10013

[21] Appl. No.: 505,144

[22] Filed: Jun. 16, 1983

[51] Int. Cl.[4] ..... A43B 23/00

[52] U.S. Cl. ..... 36/132; 36/136; D2/314

[58] Field of Search ..... 36/132, 136; D2/314, D2/315, 309, 326

[56] References Cited

U.S. PATENT DOCUMENTS

| | | | |
|---|---|---|---|
| D. 143,392 | 1/1946 | Barlow | D7/7 |
| D. 261,695 | 11/1981 | Gamm | D2/314 |
| 294,020 | 2/1884 | Eisendrath . | |
| 537,364 | 4/1895 | Rogers . | |
| 1,502,919 | 7/1924 | Seib . | |
| 2,478,411 | 8/1949 | Martin . | |
| 2,712,700 | 7/1955 | Solomon . | |
| 3,018,570 | 1/1962 | Bliese . | |
| 3,631,613 | 1/1972 | Brettell | 36/25 Q |
| 4,280,287 | 7/1981 | Gulbransen | 36/136 |
| 4,296,559 | 10/1981 | Gamm | 36/136 |

FOREIGN PATENT DOCUMENTS

| | | | |
|---|---|---|---|
| 37486 | 5/1982 | Rep. of Korea | D2/309 |
| 2110521 | 6/1983 | United Kingdom | 36/136 |

*Primary Examiner*—Steven N. Meyers

*Attorney, Agent, or Firm*—Nolte, Nolte and Hunter

[57] ABSTRACT

A zippered pocket for an athletic shoe is formed as a pipe-shaped layer of material having an opening for receiving small personal items such as keys, rolled or folded currency and the like. A cloth upon which the zipper is formed is stitched upon assembly intermediate the pipe-shaped layer of material and the liner material of the shoe quarter and, defines the upper edge of the bowls along its upper edge, stitched intermediate the eyestay and an upper lateral extent of the quarter. The vamp of the shoe is provided with a cover abutting an upwardly extending forward edge of the bowl. Stops are provided at the ends of the zipper. One such is defined by a narrow upwardly extending portion of the pipe bowl intermediate the termination of the zippered portion and the rear edge of the bowl. The other zipper termination is adjacent that upwardly extending portion of the vamp cover abutting the upward curving forward edge of the bowl.

2 Claims, 5 Drawing Figures

ZIPPERED ATHLETIC SHOE POCKET

BACKGROUND OF THE INVENTION

This invention relates generally to athletic shoes, and more particularly, pertains to a species of formed zippered pocket arranged laterally of the shoe and finding use in storage of personal items such as coins or keys to be accessible to a jogger or another athlete. A second species is taught in my related co-pending application, numbered Ser. No. 505,134 and filed concurrently herewith.

Portability of personal items during a period of exercise or athletic activity has always been sought, the desirability being most apparent when a jogger desires to be unfettered during, for example, the course of a cross-country exercise. Various means have been employed for assuring the safety of one's personal items, particularly where the items include currency. For example, in the early U.S. Patent to Diemer, U.S. Pat. No. 654,388, means were disclosed for securing valuables within the calf portion of a shoe, and more specifically, upon its internal portion that rests against the leg. Other approaches to securing one's valuables have included various types of pocket structures used in association particularly with boots. Noteworthy are those disclosed in U.S. Patents to Wirsching, U.S. Pat. No. 2,289,341; McAuslin, 1,100,758 and Avis, 1,342,149.

More modernly considerable thought has been given to various types of structures for forming pockets within shoes and boots while requirements for decorativeness have been satisfied through the addition of a purse or the like attached to the front of the shoe upper. In such instances, additional holding means have been provided for securing the same to the laces of the shoe. Certain of these developments are represented by U.S. Patents to Corley, U.S. Pat. Nos. 2,908,982; Bliese, 3,018,570; Solomon, 2,712,700 and Perry, U.S. Pat. No. 2,662,677. In each instance, the utility has been provision of means for holding some personal item, such as money, in a concealed fashion upon its wearer.

Recent advances in the art have suggested provision of a pocket part that can be built structurally integrally of the quarter part or portion of the shoe so as to hold smaller personal items, such as keys and money, while further incorporating, in certain instances, a flap that protectingly covers the pocket and further enhances the ability of the shoe to prevent untimely loss of such items. Structure of the sort having the utility described is disclosed in U.S. Pat. No. 4,296,559 issued to Gamm. An alternative is disclosed in U.S. Pat. No. 4,280,287 issued to Gulbransen which provides a teaching of a flat sheet of material fastened to the outer side of either the left or right athletic shoe of the user. The sheet is fastened by stitching, riveting, gluing or the like, or, may be formed integrally with the athletic shoe upper. The sheet of material is mounted behind the normal crease area of an athletic shoe which normally parallels the juncture of the toes with the sole of the human foot. A compartment having an opening at one end thereof is formed by the flat sheet of material during construction of the shoe. The opening is placed higher than the remaining part of the compartment. The sheet of material is fastened to the upper of the athletic shoe generally parallel to the tongue thereof. Additionally, there is provided a closure flap having closure means for sealing the opening of the compartment. Suggested closure means include zippers, a Velcro fastener (hook and pile closure), snaps, buttons or any other means that serve the purpose.

In my related co-pending application numbered Ser. No. 505,134, filed June 16, 1983, certain variations in and modifications to structurally integrally formed pockets are disclosed. As will be apparent from a reading of the specification thereof, simplicity of fabrication of component parts and ease of formation of the same into an assembled shoe have been goals remaining to be completely attained. From a view of the prior art cited hereinabove, a conclusion is readily derived that ease of fabrication and assembly, along with cost reduction in provision of athletic shoes provided with functional zippered pockets are areas of desirable technological advance in the art.

SUMMARY OF THE INVENTION

Structure defining the athletic shoe and zippered shoe pocket of the present invention includes a sole, an upper, a shank therebetween, a vamp forming the front portion of the upper body of the shoe, a vamp cover, a lacing support area including the eyestay, and, a pocket part joined to a portion of the side of the shoe known as the quarter. The pocket portion is formed by stitching a layer of pipe-shaped material to the shoe quarter. Stitching is provided along the pipe stem and upwardly at an angle under the bowl to a point below the eyestay. The bowl of the pipe is secured along the upper edge by stitching shared with the eyestay. In a preferred embodiment of the present invention, a zipper is formed in the pocket; i.e., within the bowl, and has its ends terminating adjacent the vamp cover; and, at its opposite or distal end, within the material forming a portion of the pipe bowl. Stops are provided at the ends of the zipper. One such is defined by a narrow upwardly extending portion of the pipe bowl intermediate the termination of the zippered portion and the rear edge of the bowl. In a preferred embodiment, the other zipper termination is adjacent that upwardly extending portion of the vamp cover abutting the upward curving forward edge of the bowl.

It may be apparent that a species of novel useful pockets for an athletic shoe has been described hereinabove.

OBJECTS OF THE INVENTION

It is, therefore, an object of the present invention to provide a zippered pocket for an athletic shoe which provides athletes with a place to store keys, currency or other valuables while engaging in athletic activities.

It is another object of the present invention to provide a zippered pocket for an athletic shoe which holds keys, currency or other valuables during the course of an athletic event while protecting the same from elements tending to damage them.

It is yet another object of the present invention to provide a zippered pocket for an athletic shoe formed integrally therewith and relying on stitches common to other portions of the shoe.

It is still another object of the present invention to provide a zippered pocket for an athletic shoe which does not interfere with the normal flexure and other movements of the athletic shoe which occur during use by a participant in athletic activities.

The invention possesses other objects and advantages especially as concerns particular characteristics and features thereof which will become apparent as the specification continues.

Various aspects of the present invention will evolve from the following detailed description of the preferred embodiment thereof which should be taken in conjunction with the heretofore described drawings.

DETAILED DESCRIPTION OF PREFERRED EMBODIMENT

Figure 1:
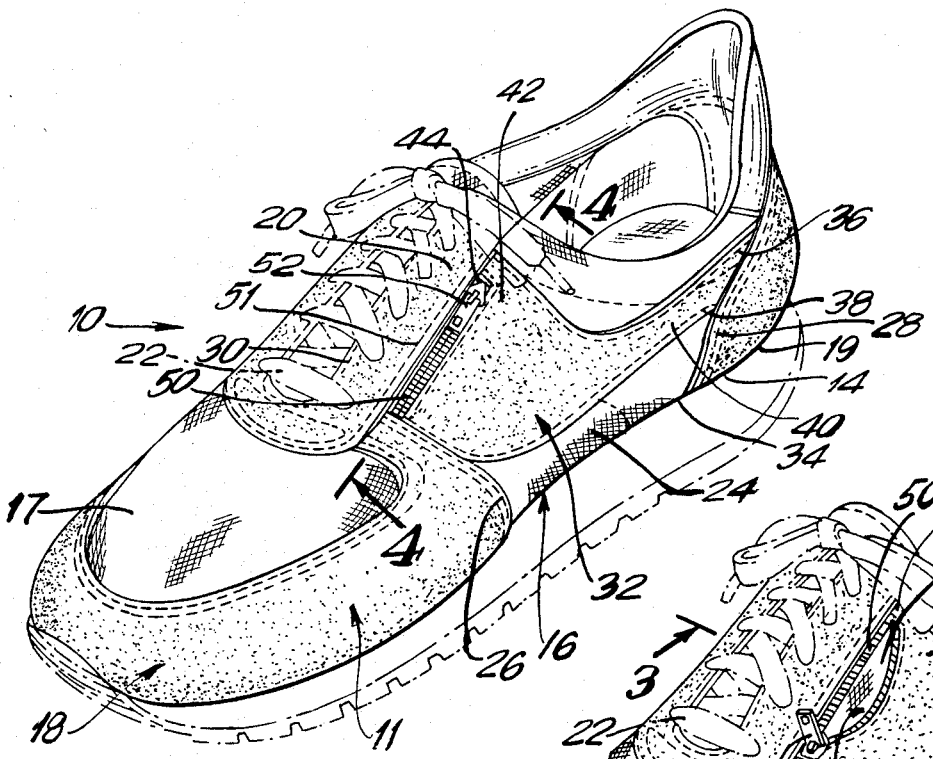
FIG. 1 provides a perspective view of the front and side portions of the shoe showing the zippered shoe pocket of the present invention formed upon the quarter portion thereof.

With reference to FIG. 1, there is shown quilted athletic shoe 10 of the usual construction with the upper 11 formed upon and secured to sole portion (shown in phantom in FIG. 1) as at shank 14 to the shoe quarter 16, to the vamp 17 and its cover 18 and to the heel as at 19. An eyestay 20 is stitched to the upper 11 of the shoe 10 along a portion of the upper periphery of the quarter 16, and is there provided for securing the laces 22 thereby enabling the shoe to be secured to the foot of an athlete. The quarter 16 forms an integral part of quilted upper 11 which consists of a liner of material as at 24 having one or more layers joined by stitches as at 26 and 28 which, for purposes of discussion herein, may be viewed as delineating the quarter of the shoe 10. The stitches 30 are provided for securing the eyestay 20 to the upper periphery of the quarter 16. Intermediate the lower periphery of the eyestay 20 and liner material 24 of the quarter 16, there is inserted a portion of the upper periphery of bowl portion 32 of a pipe-shaped layer of material to be described more fully hereinafter. The lower edge of the liner 24 is turned under with the shoe quarter 16 as at 34 and is stretched along the shank 14 for adherence with the sole 12 of the athletic shoe with the zippered pocket of the present invention.

The pipe-shaped pocket covering 32 is attached to the shoe quarter 16 by means of stitches 36 and 38. The stitches 36 and 38, as shown, extend along the rearward and forward edges of the bowl portion 42 of the pipe shaped pocket covering 32 initially downwardly and then rearwardly along the upper and lower edges of the stem 40 of the pipe-shaped pocket covering. Stitches 39 secure the rearward edge of the vamp cover 18 to the material of liner 24. Additionally, stitches 38 and 39 secure the forward edge of the bowl 32 and the rearward edge of the vamp cover 18 to the liner 24 in contiguity one with the other. Stitches 36 terminate at the upper rearward edge of the bowl where there is defined a small upward extension of the bowl which underlies the stitches 51 securing the side edges of the eyestay to the quarter. The forward edge of the bowl terminates at a distance spaced from the side edge of the eyestay so that, as shall be discussed, an upper portion of the rearward edge of the vamp provides a stop for a zipper for opening and closing the pocket. The other stop at the other end of the zipper is provided by the upper extension of the bowl at the rearward edge thereof.

Figure 2:
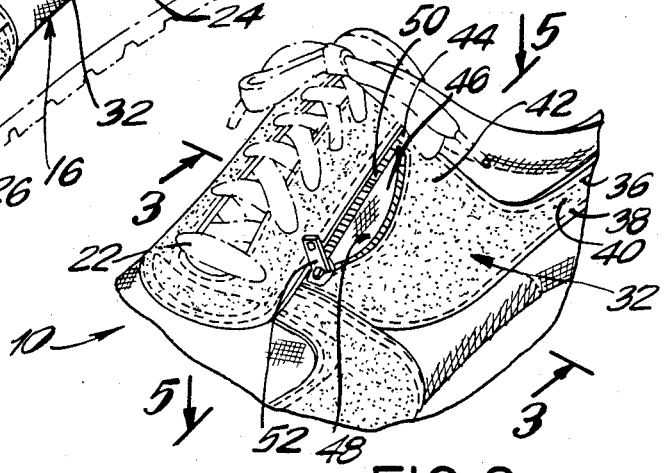
FIG. 2 is a truncated portion of FIG. 1 showing the various portions of the shoe associated with the zippered pocket, the pocket being shown in its open or unzipped condition.
Figure 3:
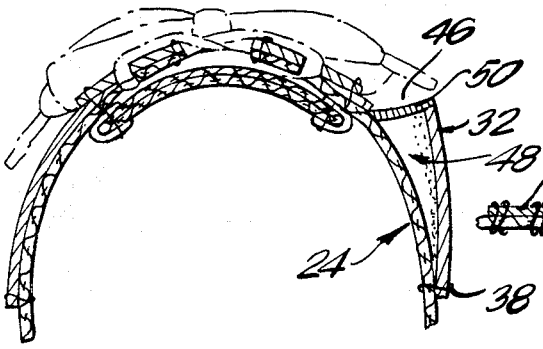
FIG. 3 is a view taken along line 3—3 of FIG. 2.
Figure 4:
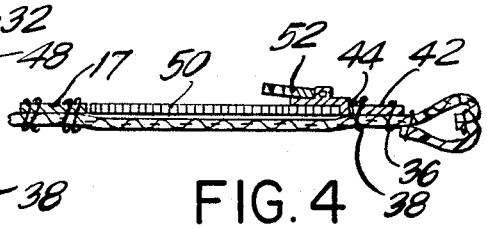
FIG. 4 is a view taken along line 4—4 of FIG. 1.

Referring now to FIG. 2, a truncated portion of the athletic shoe 10 of FIG. 1 is shown. Stitching of bowl 32 and the liner 24 is by means of stitches 36 and 38, in the latter instance directed along an upper portion of the bowl 32 thence upwardly defining the stop 44, thereby initially providing definition of the opening 46 through which currency or keys or other valuables may be inserted. The space between liner 24 and the material forming bowl 32 is in the form of a pocket 48 provided in accordance with the principles of the present invention to be zippered, opened and shut in a manner and by the means to be described hereinafter in connection with a discussion of FIGS. 3 and 4 provided to demonstrate the particular construction of the pocket 48 and its associated fastening means. More particularly, the upper region of formed pocket 48 (best seen with reference to FIG. 3) is defined as an opening 46 through operation to an open position of a closure means, such as the zipper 50. The zipper 50 is incorporated in the shoe construction by means of the continuation of bowl stitch 38 extending rearwardly to the stop 44 thence upwardly to an intersection with eyestay 20 and, additionally, by means of stitches 51 securing the eyestay 20 to the liner material 24. Movements of the zipper 50 from front to back or vice versa are constrained by abutment with an upward extension of the vamp cover 18 in the first instance and the stop 44 in the latter. The stop 44 may serve to secure the handle 52 interior of the pocket 48 to thereby provide additional security to the protected items through prevention of inadvertent displacement of the zipper downwardly exposing the items to the weather, or, in the worst case, loss should the pocket through inadvertence or accident, be opened through downward displacement of the zipper. Thus, provision of the closure means; i.e., the zipper 50 and means for securing its handle 52 within the formed pocket 48, insures the safekeeping for such items not ordinarily included in jogging paraphernalia. By these means, there is provided a greater degree of security than that ordinarily associated with an article of clothing of the sort.

With particular reference to FIG. 3, there is shown a cross section taken along the line 3—3 of FIG. 2. The zippered pocket 48 of the present invention is open to receive a key, currency, or other valuable. As previously described, the bowl portion 32 is secured to the quarter 16 by means of stitches 38 along the lower portion thereof and by means of the stitches 51 common to the bowl and the eyestay 20. The pocket 48 is defined thereby and is shown open as at 46 of FIG. 2. As will be observed, pocket 48 is dimensioned to allow insertion in the opening 46 of articles equal in length, width and depth to ordinary house keys, car keys or the like. A substantial amount of currency may be rolled and inserted therein, particularly when done so at an angle allowing an end thereof to thrust into a portion of the pipe previously indicated by the reference numeral 40 and in form resembling a pipe stem. Separation between the interior portion of the bowl 32 and the liner 24 is adequate to allow insertion of several smaller articles; e.g., locker keys, and smaller coins. The inner wall of the pocket is formed of a resilient material allowing sufficient flexure or, equivalently, stretching while eliminating undue discomfort to the athlete.

With reference to FIG. 4 and with continuing reference to FIG. 1, zipper 50 is shown positioned in abutment with stop 44 defining the closed position and demonstrating the extra measure of security inherent in the particular construction of the stop 44. The cloth 60 portion upon which the zipper 50 is formed is stitched along a lower portion intermediate the bowl 32 and the liner 24 and along an upper portion intermediate the liner 24 and eyestay 20. The cloth portion is of sufficient length to permit stitching of its ends, in the first instance, intermediate upward extension 42 of bowl 32 and liner material 24 to thereby define an inner edge of bowl 32 as the stop 44, and, in the second instance, intermediate the vamp cover 18 and the liner 24 thereby permitting repeated operation of the zipper 50 or use of the pocket 48 without the risk inherent in reliance on cloth terminations as, for example, arrangements typically provided zippered articles of clothing. The bowl 32 and vamp cover 18 provide stops in the ordinary sense as demonstrated at 44, and, additionally, enhance reliability and operation, owing to the particular means by which the zipper 50 is secured within the pocket 48.

Figure 5:
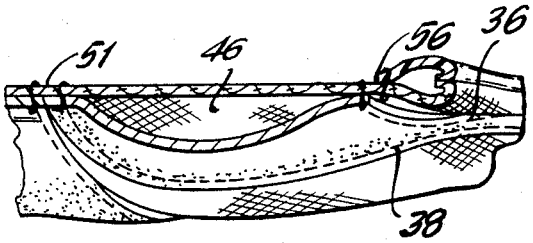
FIG. 5 is a view taken along line 5—5 of FIG. 2.

With reference to FIG. 5 and with continuing reference to FIGS. 1 and 2, bowl 32 is secured to the shoe by means of the stitches 36 and 38 along portions of its outer periphery and by means of stitches 51 securing the same at the top of the bowl or, equivalently, the upper periphery of the cloth portion of zipper 50; the stitches 51 being shown common to the bowl and eyestay 20, as previously described. The pocket 48 is shown open or unzipped as at 46 of FIG. 2, and, as indicated generally by the same reference numeral in the view of FIG. 5 taken along the line 5—5 of FIG. 2. Long term structural integrity of the pocket 48 is provided, at least in part, by the particular arrangement of the stitches shown, notably, 36, 38 and 51 with particular emphasis on the stitches 51 preventing separation of the bowl 32 from the liner material 24 allowing repeated use of the zippered pocket 48 while accommodating the heaviest article to be contained therein. Contribution to the overall structural integrity of the shoe 10, realized through provision of zipper terminations is demonstrated more clearly in relation to the particular construction and location of the bowl 32; particularly provision thereby of the stops provided at the intersection of bowl 32 and vamp cover 18 on the one hand and abutting upward extension 42 intermediate stop 44 and liner material 24 on the other.

Without further analysis, the foregoing will so fully reveal the gist of the present invention that others can, by applying current knowledge, totally adapt it for various applications without omitting features that, from the standpoint of the prior art, merely constitute essential characteristics of the generic or specific aspects of this invention, and, therefore, such adaptations should and are intended to be comprehended within the meaning and range of equivalence of the following claims.

What is claimed is:

1. An athletic shoe comprising liner material forming the upper of the shoe including the central quarter portions and forward vamp portion of said shoe, said shoe having sole and sole shank portions to which the upper is fixed at its lower extent, a vamp cover stitched to said vamp, the rearward edges thereof extending along a vertical plane substantially normal to the long axis of said shoe, an eyestay portion stitched to said quarter portions on either side of said shoe, the lateral edges thereof extending along vertical planes substantially parallel with the long axis of said shoe, said lateral edges of said eyestay portions forming an angle, at least on one side of said shoe, with the rearward edge of said vamp, a pocket cover stitched along its outer edges to said quarter portion of said at least one side of said shoe for receiving small personal items and securing the same against risk of damage or loss, said pocket cover comprising a pipe-shaped layer of material, the bottom of the bowl and the stem portion of said pipe-shaped layer extending rearwardly from the bowl portion of said pipe-shaped layer being spaced above said sole, the forward edge of the bowl portion extending in contiguity with said rearward edge of said vamp cover and terminating short of the lateral edge of said eyestay portion, a short upper extension of said bowl portion being formed at the rearward upper portion thereof and extending upwardly to and beneath the lateral edge of said eyestay portion, the upper edge of said bowl portion otherwise being spaced downwardly from the lateral edge of said eyestay portion, a zipper support cloth, means for stitching said zipper support cloth to the spaced edges of said bowl portion, said eyestay portion and said quarter beneath said eyestay portion, and a zipper supported on said support cloth, stop means at the ends of said zipper, one of said stop means comprising the rearward edge of said vamp cover at the junction between the forward edge of said bowl portion and the rearward edge of said vamp cover and the other of said stop means comprising the forward edge of said upper extension of said bowl portion.

2. The invention of claim 1 wherein said lower edge of said zipper support cloth is adapted to be received intermediate the liner and said bowl of said pipe-shaped layer of material, and upon assembly is stitched therebetween, the upper edge thereof adapted to be received intermediate the liner and the eyestay, and upon assembly is stitched therebetween, the forward edge of said cloth extending beyond the forward edge of said bowl is received intermediate the liner and the vamp cover and upon assembly is stitched therebetween, the rear portion of said cloth extending beyond said opening is received intermediate the liner and said upward extension of said bowl and upon assembly is stitched therebetween.

* * * * *